US007901274B2

(12) United States Patent
Montabaur

(10) Patent No.: US 7,901,274 B2
(45) Date of Patent: Mar. 8, 2011

(54) ROTARY FINISHING WHEEL

(75) Inventor: Werner Montabaur, Konigswinter (DE)

(73) Assignee: MONTI-Werkzeuge GmbH, Bonn (DE)

( * ) Notice: Subject to any disclaimer, the term of this patent is extended or adjusted under 35 U.S.C. 154(b) by 396 days.

(21) Appl. No.: 11/805,560

(22) Filed: May 23, 2007

(65) Prior Publication Data

US 2007/0275644 A1 Nov. 29, 2007

(30) Foreign Application Priority Data

May 24, 2006 (DE) ..... 10 2006 024 842

(51) Int. Cl.
*B24D 17/00* (2006.01)

(52) U.S. Cl. ..... 451/490; 451/506; 451/526; 451/529; 451/178

(58) Field of Classification Search ..... 451/464, 451/490, 506, 508, 526, 529, 541, 178
See application file for complete search history.

(56) References Cited

U.S. PATENT DOCUMENTS

| | | | | |
|---|---|---|---|---|
| 4,291,507 | A * | 9/1981 | Littlehorn, Jr. | 451/506 |
| 4,882,879 | A | 11/1989 | Warner | |
| 5,507,273 | A * | 4/1996 | Chiuminatta et al. | 125/13.01 |
| 5,871,399 | A * | 2/1999 | Emerson | 451/466 |
| 5,964,650 | A * | 10/1999 | Born et al. | 451/63 |
| 6,309,292 | B1 * | 10/2001 | Montabaur et al. | 451/542 |
| 6,712,062 | B2 * | 3/2004 | Wildenburg | 125/15 |
| 6,730,140 | B2 | 5/2004 | Lageson | 51/298 |
| 2002/0037694 | A1 * | 3/2002 | Katsuyama et al. | 451/526 |
| 2002/0106983 | A1 * | 8/2002 | Perrey | 451/548 |
| 2002/0132572 | A1 * | 9/2002 | Lageson et al. | 451/526 |
| 2003/0148723 | A1 * | 8/2003 | Wildenburg | 451/541 |

FOREIGN PATENT DOCUMENTS

DE 202 03 009 7/2002

* cited by examiner

*Primary Examiner* — Eileen P. Morgan
(74) *Attorney, Agent, or Firm* — Andrew Wilford

(57) ABSTRACT

A rotary tool for surface machining has a disk having an elastomeric outer periphery, an array of angularly spaced elastomeric teeth projecting radially and each having a formation forming a hinge so that the tooth can flex at the hinge.

11 Claims, 1 Drawing Sheet

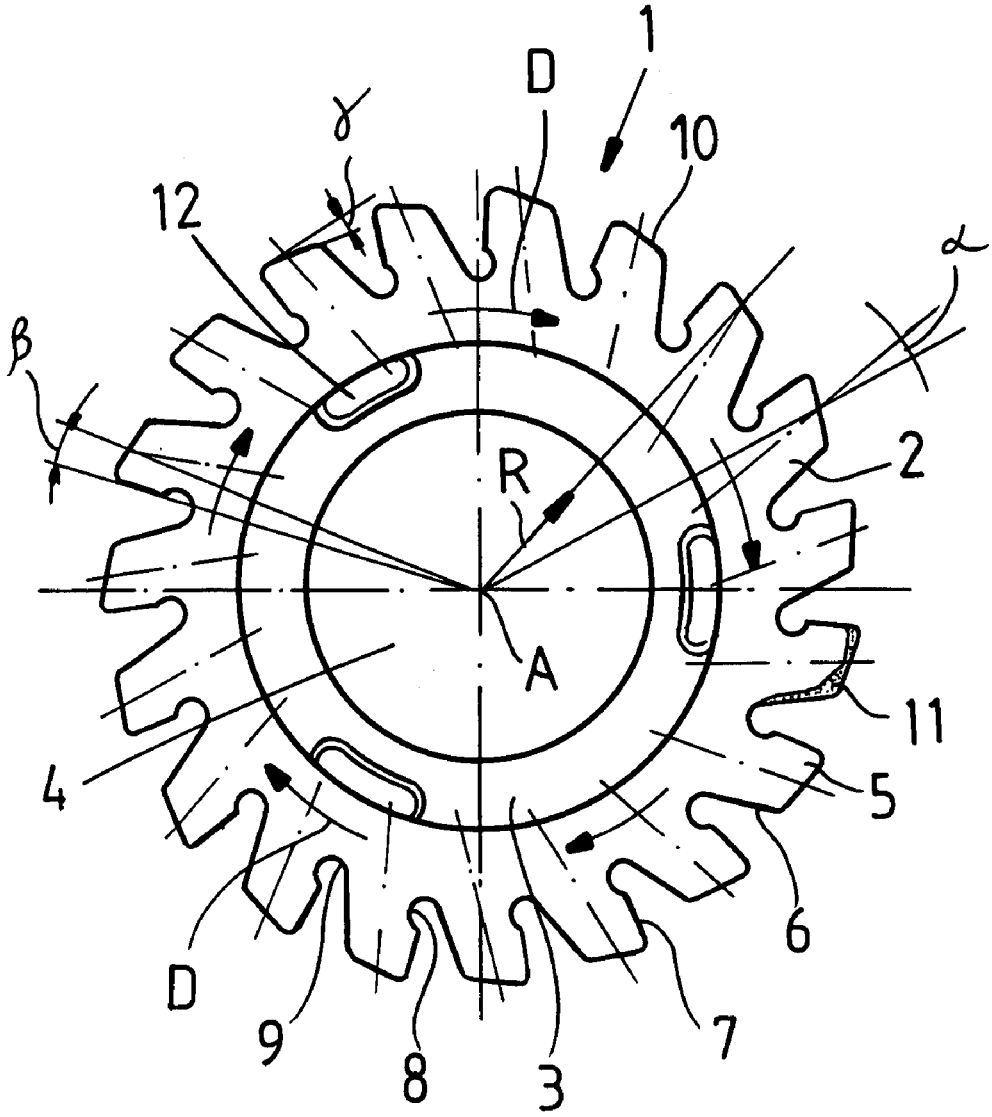
1
D
10
γ
12
α
β
2
R
A
11
4
5
6
D
9
8
3
7

ROTARY FINISHING WHEEL

FIELD OF THE INVENTION

The present invention relates to a rotary tool. More particularly this invention concerns a rotary finishing wheel.

BACKGROUND OF THE INVENTION

A rotary tool for surface finishing has a disk whose outer peripheral portion is equipped with an array of radially projecting and angularly spaced machining teeth. Advantageously the disk is elastomeric, and the machining teeth project at a small acute angle to the radial direction. This means the machining teeth are generally positioned obliquely but can also run purely radially.

Such a rotary tool is described in DE 202 03 009. The heart of the matter here is an improved grinding disk for removing adhesives of stickers or dirty objects on an object to be ground. The grinding disk in question can be made of soft rubber and can for example be driven in a rotary manner by a hand tool. The grinding area can also be equipped with one face which at least forms a beveled outer edge.

A similar rotary tool with machining teeth that are not positioned obliquely is the subject of U.S. Pat. No. 6,309,292. The rotary tool in question is also described as an eraser for removing residual adhesive and plastic foils from metal surfaces. To this end, the outer surface of the annular disk is pressed against the surface to be treated so that the residual adhesive and foils such as for example glued-on trim and advertising of plastic foil are softened and detached. This is performed successfully without damaging the metal surfaces concerned and more preferably painted surfaces as are customary for example with cars.

In addition to this, a rotary abrasion tool is known through U.S. Pat. No. 4,882,879 whose finishing elements are embodied as tufts of flexibly stiff plastic with abrasive embedded in the plastic. Surface machining free of damage can hardly be accomplished by means of this.

The known rotary tools for surface machining have proven themselves in principle but have reached limits where not only careful machining is required but such is to be done quickly and effectively at the same time. This is where the invention comes in.

OBJECTS OF THE INVENTION

It is therefore an object of the present invention to provide an improved rotary finishing tool.

Another object is the provision of such an improved rotary finishing tool that overcomes the above-given disadvantages, in particular whose efficiency is increased, i.e. with unchanged careful treatment of the surface the machining time compared with previous embodiments is shortened.

SUMMARY OF THE INVENTION

A rotary tool for surface machining has according to the invention a disk having an elastomeric outer periphery, an array of angularly spaced elastomeric teeth projecting radially and each having a formation forming a hinge so that the tooth can flex at the hinge.

This formation, which forms a hinge for the machining tooth within the scope of the invention, can basically be an formation which corresponds to a reduction of the cross-sectional shape of the machining tooth from a largely cuboid design. Advantageously the formation is designed as a recess for this purpose. In principle, the formation can also be embodied as a plastically deformable web provided in the machining tooth, as a web applied to the outside, as a slot etc. This means in addition to deviations from the cross-sectional shape of the machining tooth the formation alternatively or additionally is a variation of the properties of the material forming the tooth.

In any case, the formation in question ensures that the machining tooth in its longitudinal extension in the area of the formation is subjected to a certain weakening and consequently a hinge is formed. This is mostly achieved through a recess as formation.

Through this recess and the undercut formed by this hinge, the machining tooth, as already described, is deliberately and in a defined manner slightly weakened in its longitudinal extension with regard to its material thickness in the area of the hinge in question. This reduction of the material thickness naturally takes into account the loads that occur on the machining teeth as a whole and has to be dimensioned so that tearing-off of the machining teeth need not be feared. On the contrary, the hinge supports an oblique position of the machining teeth in operation beyond the oblique position which is present in a rest position or unloaded state. If the machining teeth run radially the same applies. The recess forming the hinge always supports the oblique position and joins material compressions.

Thus, the machining teeth apply themselves with their entire leading flank and additionally with their outer edge to the object to be machined so that a particularly effective grinding effect is achieved. In this context it must be taken into account that the mentioned leading machining flank of the machining tooth compared with the direction of rotation of the disk is inclined contrary to this direction of rotation. The trailing machining flank also has a corresponding inclination against the direction of rotation. This means the alignment and action of the individual machining teeth is comparable with the monofilaments of flexurally stiff plastic as employed within the scope of U.S. Pat. No. 4,882,879. However, in comparison with this, the surface to be machined is protected and more preferably painted surfaces for example as are customary with motor cars, are not damaged—similar to the description in U.S. Pat. No. 6,309,292.

It has proven to be effective if the recess or undercut forming the hinge is merely provided on one side of the machining tooth, namely on the trailing machining flank. In addition to this the described effect is particularly observed if the recess in question forming the hinge is formed on the inner end of the machining tooth. For in this way almost the entire length of the machining tooth can swivel because of the hinge in the desired manner and in addition to the oblique position preset anyhow in operation, in this way ensuring the almost full surface contact of the leading machining flank with the surface to be machined.

As a rule, the leading and the trailing machining flanks of the respective machining tooth are set at different angles relative to the radial direction. As a result, a certain compensation for the missing material thickness in the area of the hinge is made available. In this manner the machining tooth has a cross section in the form of a truncated cone or a trapeze-like cross section with wide base and narrow head, that is the leading and trailing flanks converge radially outward.

The solid or annular disk is generally manufactured from rubber or of an elastomeric plastic in which abrasive particles may be additionally embedded in the circumferential machining teeth as a whole or primarily in the leading machining flanks. Here, abrasive particles for example of corundum or such of silicon carbide, boron carbide, boron nitrite or diamond have proven to be effective. The grain size of the abrasive particles can range between extra fine and very coarse.

This grain size depends on the condition of the surface to be machined. For example, extra-fine grain size or wetting with a grinding emulsion of the leading machining flanks will be employed if, for example, residual adhesive and foils are to be removed from painted or metal surfaces. In contrast with this, medium-fine or medium-coarse abrasive particles are advisable if for example paint is to be removed from painted or metal surfaces or other surfaces or any other surface machining is desired. Coarse and very coarse abrasive particles will be used for example if scaling or removing rust from metal or steel surfaces is intended. At any rate, depending on the selection of the abrasive particles and, if applicable, the grinding emulsion, matching to the surface machining required in each case is possible.

Through the preferred elastomeric development of the disk one always has considerable elasticity of the machining teeth quasi in all three dimensional directions due to the highly polymeric construction (modulus of elasticity between 1 and 500 $N/mm^2$). In this way the rotary tool according to the invention or the foil eraser driven with speeds of for example 3000 RPM and more can also machine wavy surfaces and has a high degree of trueness through the large-area contact with the surface to be machined of the machining teeth swiveling hinge-like during operation.

In this way working with low pressure is possible on the one hand but particularly high efficiency and effective removal of residual adhesive, plastic foils and the like from metal or painted surfaces is achieved on the other hand. In addition, a ventilation effect which contributes to cooling of the disk and the discharge of possible abrasive particles and constituent parts detached from the surface respectively is ensured because of the spaced machining teeth.

It has proven to be effective if each of the recesses forming the hinge is formed in the area of a connecting web coupling the machining teeth on the inner side. Actually the recess or the undercut forming the hinge and the connecting web together form a unit and together form a circular arc. As a result, both the recess forming the hinge and the connecting web can be made in a single machining step in the disk in which for example the disk equipped with the machining teeth is milled in each case at the inner end in the area of the recess forming the hinge and the connecting web.

In detail, the machining teeth have an angle of 5 to 20° to the radial direction. More preferably angles of 5 to 15° and preferentially such between approximately 10° and 12° have proven to be particularly favorable.

In addition to this, the disk is generally equipped with an inner peripheral portion with at least a mounting for a disk holder for connection to a rotating machine tool. In principle the disk can also be driven manually. However, in order to achieve the mentioned high rotation rate, power rotary machine tools making available the required speeds and the corresponding drive power are advisable.

Finally it has proven to be favorable if the machining teeth additionally have a beveled outer edge in each case which is supported in full surface contact of the machining teeth with the surface to be machined through the oblique position and hinge mobility. Actually the surface, like the leading and trailing machining flanks of the respective machining tooth, is mostly inclined against the direction of rotation of the rotary tool. Angles of a few degrees, for example 3 to 8° have proven themselves to be effective at this point. Through the oblique position of the surface of the machining teeth the disk in its outer peripheral portion has a sawtooth type circumferential profile which supports the grinding capacity. As a result, a rotary tool is produced whose elastomeric disk is preferentially equipped with specially designed and aligned machining teeth. In operation these machining teeth contact the surface of the object to be machined with almost their entire leading machining flank and its surface where they ensure effective removal of residual adhesive, foils, advertising etc. from the entire surface without damaging the surface.

BRIEF DESCRIPTION OF THE DRAWING

The above and other objects, features, and advantages will become more readily apparent from the following description, reference being made to the accompanying drawing whose sole FIGURE is an end view of the tool according to the invention.

SPECIFIC DESCRIPTION

As seen in the drawing a rotary tool 1 for surface machining is made largely of an elastomer, in this case polyurethane (PU). However it is also possible that only an outer peripheral portion 2 is made of elastomeric plastic, while is an inner peripheral portion 3 consists of thermoplastic resin.

For machining, the disk 1 is fitted to a disk holder 4 that can be rotated about a central axis A. The outer peripheral portion 2 of the disk 1 has elastically flexible teeth 5 distributed over and projecting radially outward from its circumference. These teeth 5 are all identical and are angularly equidistantly distributed about the outer periphery 2.

The machining teeth 5 each have, relative to a normal rotation direction D a straight leading machining edge or flank 6 and a straight trailing machining edge or flank 7. The leading flanks 6 and the trailing machining flanks 7 extend at respective small acute angles $\alpha$ and $\beta$ to radii R, both inclined rearwardly outwardly relative to the rotation direction D.

Actually the leading angle $\alpha$ and the trailing angle $\beta$ are different, the angle $\alpha$ being approximately 11° while the angle $\beta$ is approximately 8°. As a result, the flanks 6 and 7 of each tooth 5 converge radially outward, giving each tooth 5 a wide base or inner end and a narrow head or outer end. The angles $\alpha$ and $\beta$ of the leading and trailing machining flanks 6 and 7 ensure that the machining teeth 5 as a whole extend at a small acute angle to the radii R, specifically inclined backward against the direction D of rotation.

Of particular significance to the invention is the fact that each machining tooth 5 has a formation forming a hinge, in this case a semicircular recess or undercut 8 at the base of the trailing flank 7. The recess 8 forming the hinge in each case is located in the area of the trailing machining flank 7, specifically at the inner end of the corresponding machining tooth 5. As for the rest, the recess 8 forming the hinge directly merges with a connecting web 9 separating the machining teeth 5. Actually the recess 8 forming the hinge and the corresponding connecting web 9 together are designed as concentric circular arcs of identical radius, so that they merge into each other. In this way the connecting web 9 in question. and the recess 8 forming the hinge are formed in one manufacturing step.

In addition the machining teeth 5 each have a straight and beveled outer end face or edge 10. An angle $\gamma$ between each such edge 10 and a tangent to a circle centered on the axis A is approximately 5°, may more generally be between 3° and 8°. Like the leading machining flank 6 and the trailing machining flank 7, the beveled outer edge 10 of the machining tooth 5 is also inclined against the direction of rotation D, so that it runs outward rearward in this direction D. In this way the machining teeth 5 when in contact with a workpiece as a result of the recess 8 forming the hinge are subjected to an additional inclination so that for machining practically the entire leading machining flank 6 and the beveled outer edge 10 are in contact with the surface to be machined of the workpiece.

For this reason abrasive particles 11 may be embedded in the leading machining flank 6 and/or the beveled outer edge 10 of the machining teeth 5. These abrasive particles 11 can be of corundum with a fine grain size.

For mounting the disk holder 4 to the inner peripheral portion 3, this inner peripheral portion is equipped with arcuate and axially throughgoing slots 12 which may engage around bumps of the disk holder 4. The disk holder 4 itself is driven in the direction of rotation D by a machine tool working in a rotary manner.

I claim:

1. A rotary tool for surface machining comprising:

a disk having an annular outer periphery wholly formed of an elastomeric material; and an array of angularly spaced elastomeric abrasive teeth projecting radially from and unitary with the disk and each having relative to a rotation direction of the disk a leading flank, a trailing flank, and an inset at a base of the respective trailing flank and forming a hinge so as to reduce thickness or width of the respective tooth at the base thereof, the tooth being elastomerically flexible at the hinge as a result of its reduced thickness or width and less flexible radially outward of the inset, whereby when the tool is rotated in the direction with the teeth pressed radially outward against a workpiece the teeth will flex back in the direction at the respective insets.

2. The rotary tool defined in claim 1 wherein the inset is a groove.

3. The rotary tool defined in claim 2 wherein the disk is formed with web edges extending angularly between the teeth and the groove merges smoothly with the respective web edge.

4. The rotary tool defined in claim 3 wherein each groove and the respective web edge are of the same radius of curvature and have a common center.

5. The rotary tool defined in claim 2 wherein each trailing edge extends at a small acute angle to a respective radius from a center of the disk.

6. The rotary tool defined in claim 5 wherein each trailing flank extends relative to the rotation direction rearward and outward.

7. The rotary tool defined in claim 2 wherein each leading flank extends at a small acute angle to a respective radius from a center of the disk.

8. The rotary tool defined in claim 7 wherein each leading flank extends relative to the rotation direction rearward and outward.

9. The rotary tool defined in claim 2 wherein the flanks are substantially straight and converge radially outward.

10. The rotary tool defined in claim 9 wherein each tooth has a straight outer edge extending at an acute angle to a respective tangent to a circle centered on an axis of rotation of the disk.

11. The rotary tool defined in claim 10 wherein each straight outer edge is inclined inward and rearward in a rotation direction of the disk.

* * * * *